US007819634B2

(12) United States Patent
Kolodziej et al.

(10) Patent No.: US 7,819,634 B2
(45) **Date of Patent: *Oct. 26, 2010**

(54) AIR COOLED PACKAGED MULTI-STAGE CENTRIFUGAL COMPRESSOR METHOD

(75) Inventors: Robert M. Kolodziej, Varysburg, NY (US); Edward S. Czechowski, Orchard Park, NY (US); Donald E. Miller, Jr., Depew, NY (US); John R. Battershell, Hamburg, NY (US); Michael Thompson, West Seneca, NY (US); John C. Bartos, Williamsville, NY (US); Frank Athearn, Orchard Park, NY (US); Robert Rajeski, Williamsville, NY (US)

(73) Assignee: Cameron International Corporation, Houston, TX (US)

( * ) Notice: Subject to any disclaimer, the term of this patent is extended or adjusted under 35 U.S.C. 154(b) by 152 days.

This patent is subject to a terminal disclaimer.

(21) Appl. No.: 12/173,710

(22) Filed: Jul. 15, 2008

(65) Prior Publication Data

US 2008/0273991 A1 Nov. 6, 2008

Related U.S. Application Data

(60) Division of application No. 10/769,666, filed on Jan. 30, 2004, which is a continuation of application No. 09/918,119, filed on Jul. 30, 2001, now Pat. No. 6,692,235.

(51) Int. Cl.

| | |
|---|---|
| ***F04B 3/00*** | (2006.01) |
| ***F04B 23/04*** | (2006.01) |
| ***F24H 3/00*** | (2006.01) |
| ***F28F 9/22*** | (2006.01) |

(52) U.S. Cl. ..... 417/53; 417/243; 165/47; 165/145

(58) Field of Classification Search ..... 417/243, 417/244, 313, 53; 29/890.031
See application file for complete search history.

(56) References Cited

U.S. PATENT DOCUMENTS 3,640,646 A 2/1972 Hornschuch et al.

(Continued)

FOREIGN PATENT DOCUMENTS

SU 1687860 5/1989

OTHER PUBLICATIONS

Higher Capacity Air Compressors; Processing, vol. 21, p. 61, Feb. 1975.

(Continued)

*Primary Examiner*—Charles G Freay
(74) *Attorney, Agent, or Firm*—Fletcher Yoder

(57) ABSTRACT

Provided is a method including routing a compressed gas from a centrifugal gas compressor through at least one of a plurality of air coolers, and directing air flow through the plurality of air coolers, wherein the plurality of air coolers are arranged adjacent to one another in a single plane that is transverse to the air flow. Further provided is a method including removing tube cores from a cooler chamber of a liquid cooler of a centrifugal gas compressor, coupling a chamber port of the cooler chamber to a first port of an air cooler, and coupling a second port of the air cooler to a compressor port of a stage of the centrifugal gas compressor.

25 Claims, 8 Drawing Sheets

U.S. PATENT DOCUMENTS

| | | | | |
|---|---|---|---|---|
| 3,644,054 | A | 2/1972 | Pilarczyk | |
| 3,736,074 | A | 5/1973 | Kilbane et al. | |
| 3,907,032 | A | 9/1975 | DeGroote et al. | |
| 4,311,439 | A | 1/1982 | Stofen | |
| 4,618,310 | A | 10/1986 | Michelson | |
| 4,635,712 | A | 1/1987 | Baker et al. | |
| 4,889,180 | A | 12/1989 | Sloan | |
| 5,042,970 | A | 8/1991 | Rodgers | |
| 5,106,270 | A | 4/1992 | Goettel et al. | |
| 5,287,916 | A | 2/1994 | Miller | |
| 5,386,873 | A | 2/1995 | Harden et al. | |
| 5,718,563 | A | 2/1998 | Hutchinson | |
| 5,795,138 | A | 8/1998 | Gozdawa | |
| 5,844,333 | A * | 12/1998 | Sheerin | 310/52 |
| 6,221,130 | B1 | 4/2001 | Kolodziej et al. | |
| 6,447,264 | B1 | 9/2002 | Lucas et al. | |
| 6,692,235 | B2 | 2/2004 | Kolodziej et al. | |
| 7,044,716 | B2 | 5/2006 | Fabry | |
| 2004/0184927 | A1 | 9/2004 | Kolodziej et al. | |

OTHER PUBLICATIONS

Ingersoll-Rand Oil and Gas News, Feb. 21, 2000.

Extra Instrumentation Can Cut Compressor Operating Costs; Additional Monitors Help Identify Points of Efficiency Loss for Preventative Maintenance; Hydraulics and Pneumatics, vol. 38, p. 86, Sep. 1985.

Quest for Excellence: 1994 Plant Engineering Product of the Year Finalists, Plant Engineering, vol. 48, n. 15, p. 34, Nov. 15, 1994.

Types of Air Compressors; Ingersoll-Rand Web Page, http://air.irco.com/asg/air_system_info/compressortype, printed Jun. 17, 2003.

Petstar 3; Ingersoll-Rand Web Page, http://air.irco.com/asg/centrifugal/pbm/petstar3, printed Jun. 17, 2003.

A Short Explanation of Pinch Technology; American Process, Inc., Internet Technology, 2 Pages, Date Unknown.

Air Compressor Cooler Approach Temperature; Clean Dry Air, Inc., http://www.cleandryair.com/approach_temperature.htm, Internet Technology, 2 Pages, Apr. 4, 2003.

SKIL in Pinch Technology; http://www.sucrose.com/energy.html, Internet Technology, 10 Pages, Apr. 4, 2003.

H. Van Ormer, Compressors Drive the System; Hydraulics & Pneumatics, Dec. 2002, pp. 43-48.

Compressed Air and Gas Handbook, 4th Edition, pp. 2-116 to 2-119 and 3-1 to 3-3 and 3-20 to 3-21.

50-400HP (37-300kW) Sierra; Air Compressor Line Advertisement from Ingersoll-Rand Website, http://www.irco.com/asg/rotary/sierra.asp, Jun. 17, 2003.

Air Cooled Oil-Free Air, Turbo Air Cooled™ 2000 Centrifugal Compressors, Cooper Turbocompressor, Brochure, copyright 2001.

* cited by examiner

SPECIFIC POWER COMPARISON

AIR COOLED PACKAGED MULTI-STAGE CENTRIFUGAL COMPRESSOR METHOD

CROSS-REFERENCE TO RELATED APPLICATIONS

This application is a divisional of U.S. patent application Ser. No. 10/769,666, filed on Jan. 30, 2004, entitled "Air Cooled Packaged Multi-Stage Centrifugal Compressor System", which is herein incorporated by reference in its entirety, and which is a continuation of U.S. patent application Ser. No. 09/918,119, filed on Jul. 30, 2001, issued as U.S. Pat. No. 6,692,235, on Feb. 17, 2004, and entitled "Air Cooled Packaged Multi-Stage Centrifugal Compressor System," which is herein incorporated by reference in its entirety.

FIELD OF THE INVENTION

The field of this invention is air-cooled centrifugal compressor packages including some applications for their use and the waste heat generated from them.

BACKGROUND OF THE INVENTION

When users in a variety of industrial applications considered a compressed gas system there were many choices. These systems could serve as plant air systems to operate a wide variety of machine components and control devices. Depending on the pressure and volume requirements of a particular location different compression packages could be used for the application. Each system had its unique advantages and disadvantages. Generally speaking as power costs increased worldwide, a greater focus was placed on multi-stage centrifugal compression systems over positive displacement designs such as screw compressors. The reason for this was that the positive displacement machines became less efficient as they wore, in normal use. In general, the initial efficiency of centrifugal compressor packages was higher than the positive displacement counterparts and the centrifugal compressor efficiency would maintain a nearly constant level over long periods of operation. Centrifugal compressors also offered excellent part load efficiencies and eliminated sliding or rubbing parts, such as in screw compressors, which would cause efficiency loss over time.

Other advantages of centrifugal compressors are high reliability, the availability of oil-free air and ease of maintenance. Some features that made these advantages possible were: non-contact air and oil seals; stainless steel compression elements; high quality gear design using unlimited life pinion bearings; the elimination of the need for oil removal filters; elimination of need to remove wearing parts; and an accessible horizontally split gearbox for quick inspections.

In the past, multi-stage centrifugal compressor units had been sold with inter-stage water-cooling to improve efficiency of the overall system. Use of water-cooled designs involved a host of significant associated costs, especially cooling towers. It also precluded applications of water-cooled centrifugal compressor packages in locations where water was not readily available or prohibitively expensive. Some potential installations also had space constraints that made use of water-cooled centrifugal compressors impossible. Water cooled systems involving cooling towers not only had space and installation cost elements but also required substantial operating costs for things such as make up water, pumping costs, chemicals including glycol to deal with potential freezing problems. Even connection to existing closed loop chilled water systems, assuming they had the requisite capacity, involved significant piping installation expenses and some of the same incremental operating costs previously described.

Multi-stage centrifugal compressor packages have, in the past, been highly engineered to be space efficient. They have been sold as a compact package with the intercoolers below a gearbox that connects all three stages to a single drive motor. The lubrication system reservoir would be provided as a separate casting from the intercoolers and mounted alongside. FIG. 5 illustrates this layout. There the drive motor 10 is connected through a gearbox 12 to the first stage 14, the second stage 16 and the third stage 18 centrifugal compressors. Compressed gas from the first stage 14 enters cooler 20 and passes into the second stage 16 through inlet pipe 22. The second stage 16 has an outlet line 24 into cooler 26 and the third stage, which receives the cooled gas from cooler 26, has its exhaust directed to an after-cooler 28. The final discharge is through line 30 which is directed upwardly adjacent the inlet line 32 to the first stage 14. A control panel 34, which sometimes requires cooling, is at one end of the skid package as is a reservoir for the lubricating oil 36, which has its own cooler (not shown). For noise control and appearance purposes, the skid further comprised a metal paneled enclosure. It should be noted that while a water-cooled system is illustrated in FIG. 5, that Figure is not considered or labeled prior art because one aspect of the present invention is to retrofit such units to air cooled operation with a minimum of modifications. This mode of the invention will be described in more detail below.

Accordingly, with the layout of skids for multi-stage centrifugal compressor packages having gained acceptance in the industry not only for its efficient performance but also for the compactness of the package, a challenge was presented to the named inventors to create an innovative package that would be more economical to install and operate than the previous water cooled designs but would also fit a housing and have a compact size, such as a comparable footprint, for a given driver horsepower. The present invention provides air-cooling as an option on a multi-stage centrifugal compressor package with no significant performance penalty. The present invention is packaged as a unit in a comparably sized enclosure having a footprint not larger than a water-cooled unit having the same driver horsepower. It does not require the space or expense of a cooling tower. The present invention captures the exhaust heat from air-cooling in a variety of ways. The present invention permits optimization of performance and power consumption in an air-cooled environment by matching the cooling capacity to the produced output. Specialized packages can be created for particular applications such as the air separation industry where there is a need for compressed air as well as compressed nitrogen from a single package. The unit can be used to filter the room air in the environment in which it is installed. It can be a retrofit of existing water-cooled units, such as shown in FIG. 5, into an air-cooled system with minimal piping modifications and elimination of the previously necessary cooling tower, if it was exclusively dedicated to cooling duty for the centrifugal compressor package.

In the past, exhaust gas from a second stage water-cooled unit has been used to regenerate air dryers filled with desiccant. This technique is illustrated in U.S. Pat. No. 6,221,130. There were positive displacement compressor packages offered with an air-cooling feature. However, in the realm of centrifugal multi-stage compressor packages, there have never been air-cooled commercial units available. The industry, as well as the end user customers, were convinced that an air-cooled centrifugal multi-stage package could not deliver the efficiency of the known water-cooled designs. The inventors, facing this prejudice, were forced to present technical data from testing such an air-cooled unit to potential customers. Data that is not normally part of ordinary commercial transactions in water cooled designs, such as FIG. 7, had to be given to potential customers to persuade them that the promised results were indeed achievable. Competitors, who offered positive displacement air-cooled units, had failed to seize upon a vast market that had gone unserved for so many years. After rollout of the air-cooled package, the customer response has been unprecedented and there is now interest from competitors to develop competing products.

Part of the difficulty in accomplishing the objective of an air cooled multi-stage centrifugal compressor unit of comparable performance to a water cooled design was to be able to package the entire system in a comparable volume while getting comparable performance. Tube/fin air-to-air exchangers were tested. While such units were operative, they didn't match the cooling performance of the counterpart water-cooled systems then commercially available. They also occupied significantly more space than the water cooled counterparts. The inventors were encouraged by these results and proceeded to further optimize the performance and compactness of the assembly. What resulted was the matching up of the plate fin air cooler type to the multi-stage compressor package in a confined volume. This combination rendered comparable performance to a water cooled unit of identical size while keeping the package size comparable. This became the optimal design for commercial use. These and other features of the present invention will be more readily understood from a review of the preferred embodiment, which appears below.

SUMMARY OF THE INVENTION

An air-cooled multi-stage compression system using centrifugal compressors is disclosed. It is packaged in a comparable volume and using the same footprint as a water-cooled unit having the same driver horsepower. The performance is comparable and opportunities for use of the waste heat are available. Existing water-cooled units can be retrofit to run in an air-cooled mode. Special applications such as combined air compression and nitrogen compression, useful in air separation applications, are presented. The circulating cooling air can make the unit into an air filter of its surrounding space. Cooling air is drawn through the enclosure before being forced through the coolers above. This air movement can cool compressor housings, the control panel and the drive motors mounted in the enclosure.

DETAILED DESCRIPTION OF THE PREFERRED EMBODIMENT

Figure 1:
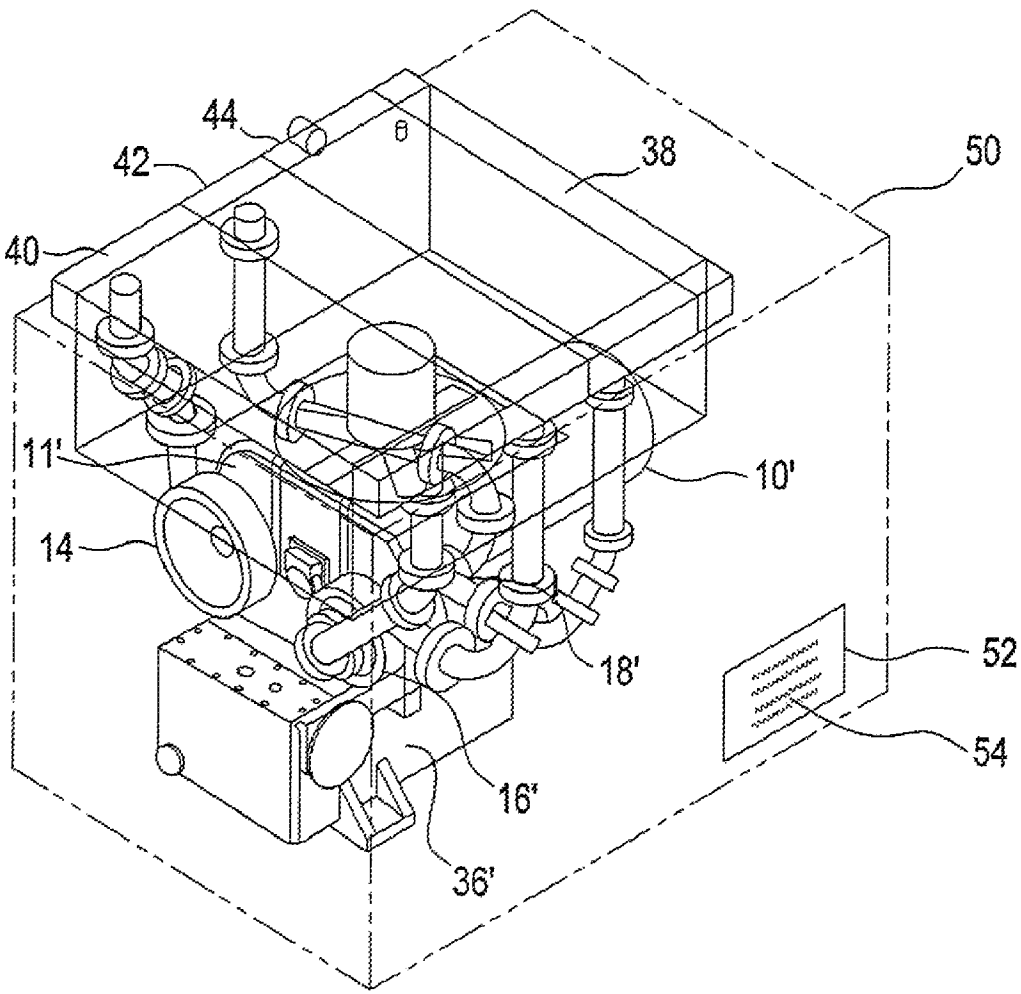
FIG. 1 is a perspective view of the air-cooled centrifugal compressor package.
Figure 2:
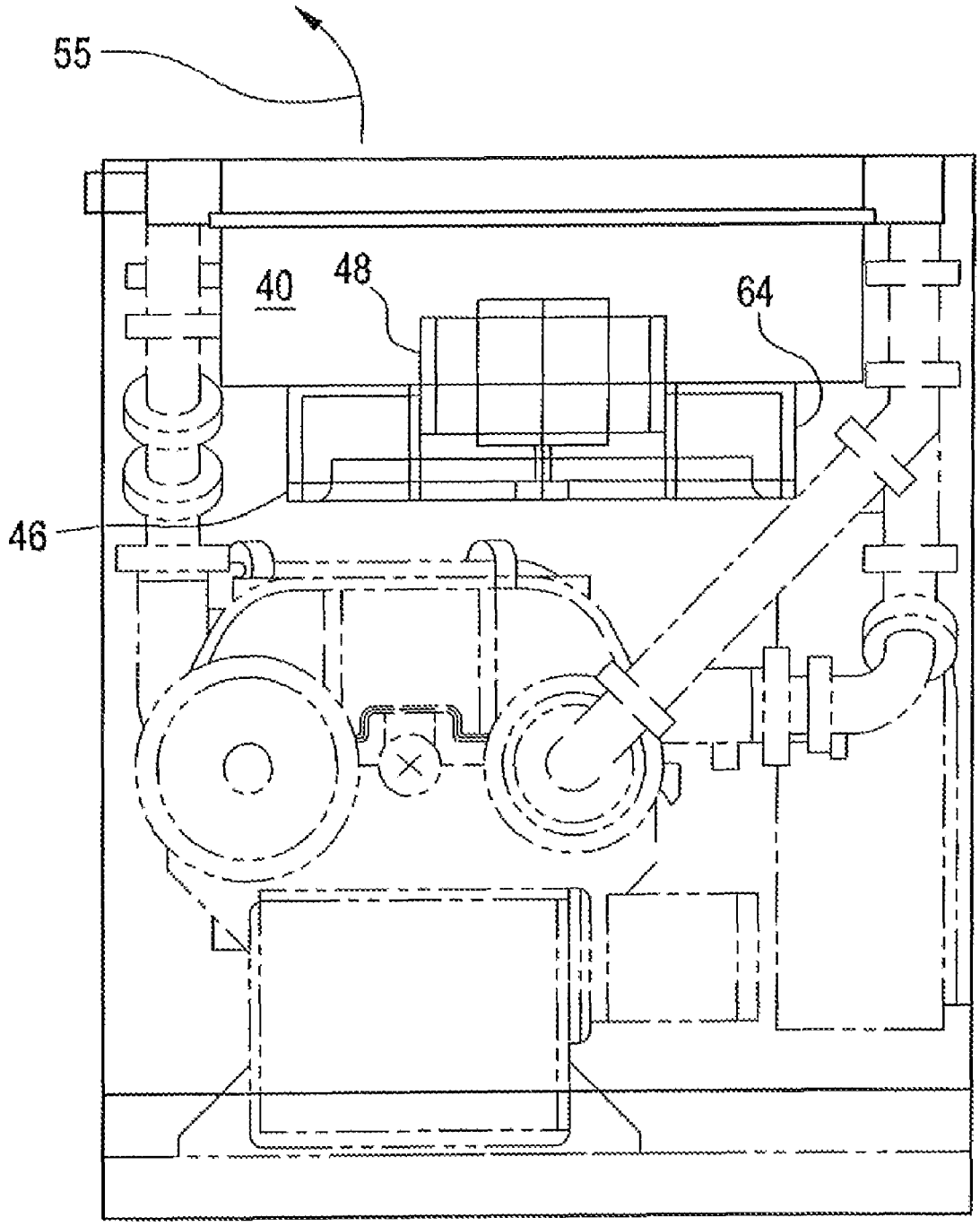
FIG. 2 is an end view of the view in FIG. 1.
Figure 3:
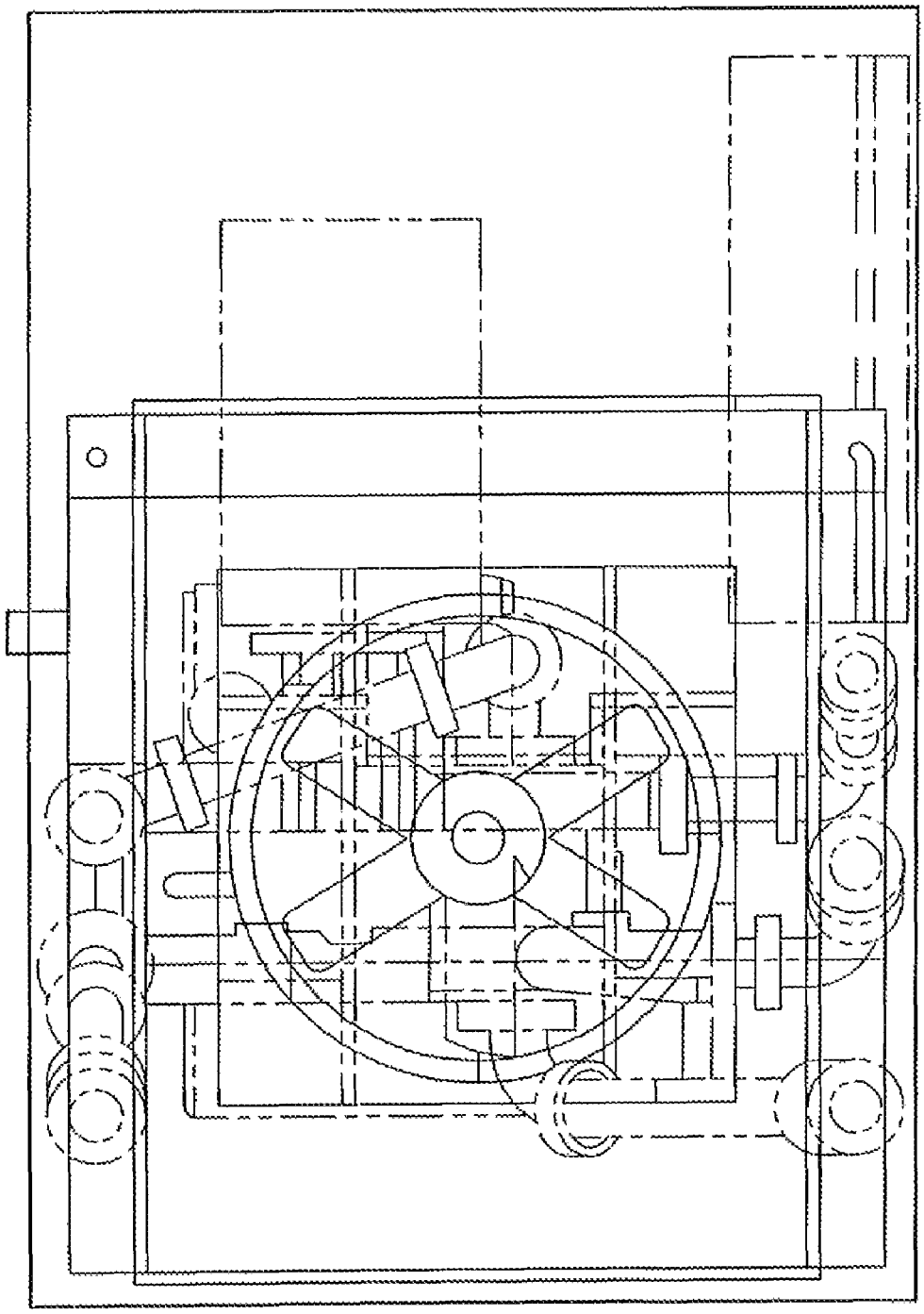
FIG. 3 is a side view of the view in FIG. 1.
Figure 4:
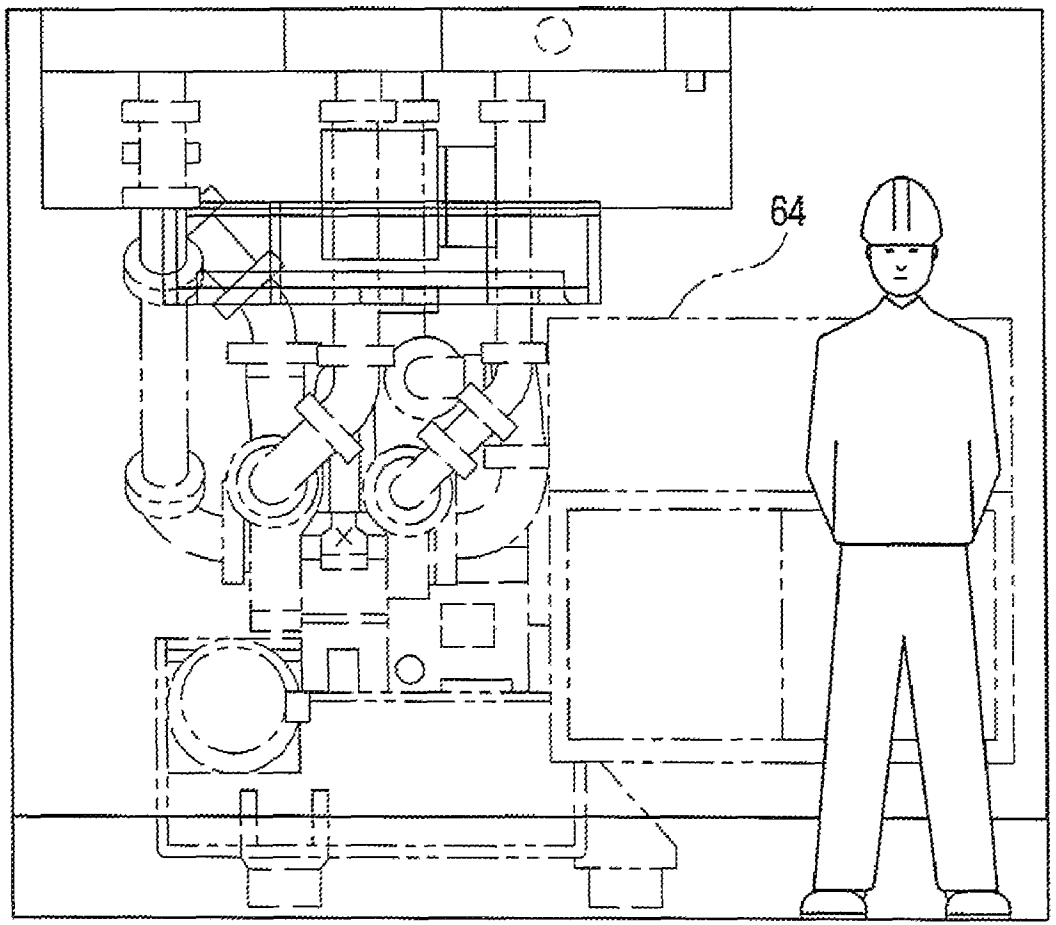
FIG. 4 is a top view of the view in FIG. 1.
Figure 5:
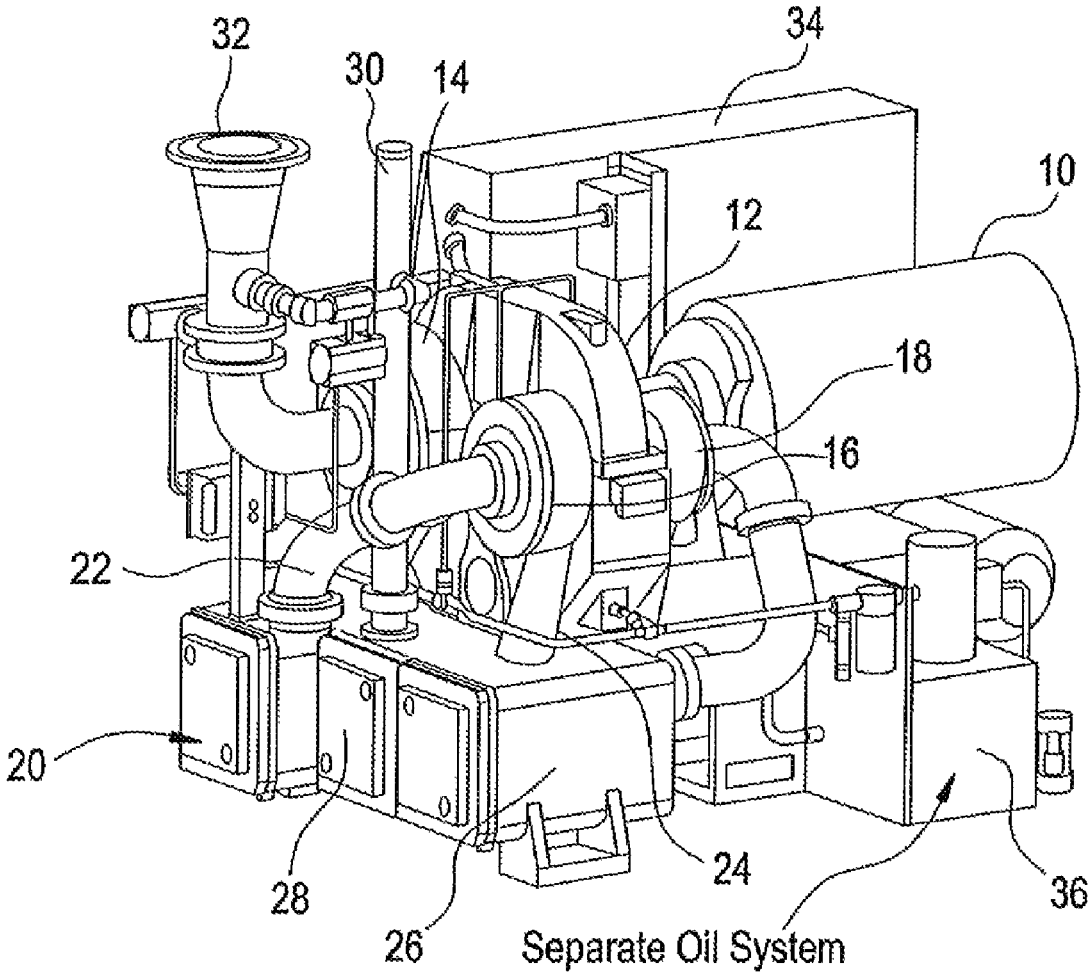
FIG. 5 PRIOR ART
FIG. 5 is a perspective view of a water-cooled centrifugal compressor package, which can be retrofitted to run in an air-cooled mode.

The preferred embodiment of the present invention is illustrated in FIG. 1. It illustrates a multi-stage centrifugal compressor unit newly designed for air-cooled operation. The differences from the previously available water-cooled designs can be more readily appreciated by comparing FIGS. 1 and 5. Again, it should be kept in mind that FIG. 5 is readily converted from water to air cooled operations with minor piping modifications, as will be described below. Comparing FIG. 1 to FIG. 5, it can be seen that the water coolers 20, 26, and 28 have been eliminated from their position below the three stage compressors 14', 16', and 18'. Instead, the lubricating oil reservoir 36' is now below the gearbox 12' and can optionally be cast as a part of it. Although not shown in FIG. 5 the separate oil cooler and its water connections have been eliminated in the FIG. 1 design by an air-to-air cooler 38. Three additional air to air coolers 40, 42, and 44 are mounted adjacent to each other in a horizontal plane to respectively cool the discharge from the three stages of centrifugal compressors 14', 16', and 18'. A fan b driven by electric motor 48 preferably pushes the cooling air, in parallel, through the coolers 38, 40, 42, and 44, although a pull through design could also be used. In the push through design, the air handled by the fan is denser and has the capability of removing more heat while the pull through design offers an improved airflow distribution through the coolers. The package shown in FIG. 1 is preferably housed in a louvered enclosure, shown schematically as 50. For a 350 horsepower unit the dimensions of enclosure 50 are 116" long by 73" wide by a height range of 70-90" depending on the air cooler configuration selected. The cooling air flow through the enclosure 50 is such that air enters fairly low, through louvers 52 which can optionally have filters 54 and thus can pass over the reservoir 36' as well as the three stages of centrifugal compressors 14', 16', and 18' as well as the gearbox 12'. In this way the moving cooling air cools off these pieces of equipment as it is drawn by the fan 46. The cooling airflow also passes over the motor 48 for the fan 46 as well as the main drive motor 10'. Use of the filters 54 allows the entire unit to act as an air filter in the location where it is mounted. Thus with a fan 46 delivering 18,000 SCFM and the unit mounted in a room having a height of 27 feet and 40,000 square feet of floor space, the entire space can be filtered by the unit in about 1 hour. Additionally the filters 54 pre-filter the air to be compressed. While the compressor first stage inlet has its own filter (not shown) its life is prolonged because the air has been pre-filtered by filter 54. Another advantage of filter 54 is to keep dirt in the air sucked into the enclosure 50 from coating the compressors inside and/or fouling the cooler cores. The heated cooling air exhausted from the coolers, shown schematically as arrows 55, can be used directly to heat a building in which the unit is mounted with a minimal amount or even no ductwork. The heated air 55 can be used in other energy saving ways such as supplying heated combustion air to boilers.

While the stage temperature after cooling by air can vary, performance tests on a Cooper Turbocompressor unit TA-2000 with a 350 HP driver is shown below. The first stage 14' increased the pressure from 14.03 PSIA to 26.89 PSIA with a discharge temperature of 306.6 degrees F. Prior to entry into the second stage 16' the air was cooled to 81.8 degrees F. at a pressure of 25.78 PSIA. It was then compressed to 72.1 PSIA at 260.5 degrees F. and cooled by cooler 42 to 90.3 degrees F. In the third stage it was compressed up to 123.8 PSIA at 189.5 degrees F. and cooled by cooler 44 to 78.7 degrees F. The average cooling air inlet temperature was 75.7 degrees F. measured between the fan 46 and the coolers 40, 42 and 44. This made the realized approach in the discharge from the three stages respectively 6.1, 14.6 and 3.0 degrees F. Oil passing through cooler 38 was cooled from 137.4 degrees F. to 88.5 degrees F. for an approach of 12.8 degrees. During the performance test the unit delivered 1500 SCFM of compressed air and consumed 386 amperes. The ambient conditions were 67.3 degrees F. dry bulb with a relative humidity of 27.9%.

Those skilled in the art will recognize that the capacity of fan 46 can be altered by speed control or blade pitch control or by selective air pathway obstruction of the coolers 38, 40, 42, and 44 so that in colder weather or at times where less output is required of the unit the level of cooling provided can match the requirements of the system. Doing this also saves operating costs for the fan motor 48. Alternatively, in times of light load, the motor 48 may be cycled on and off. A control system to do this can be placed in the panel 64.

By mounting the coolers in a common horizontal plane or in parallel planes, instead of stacking the coolers one above the other, the cooling is done more efficiently. The coolest air is input to each cooler and the motive horsepower for the fan 46 can be reduced as the parallel flow through the various coolers from the fan 46 offers less resistance to flow.

Figure 6:
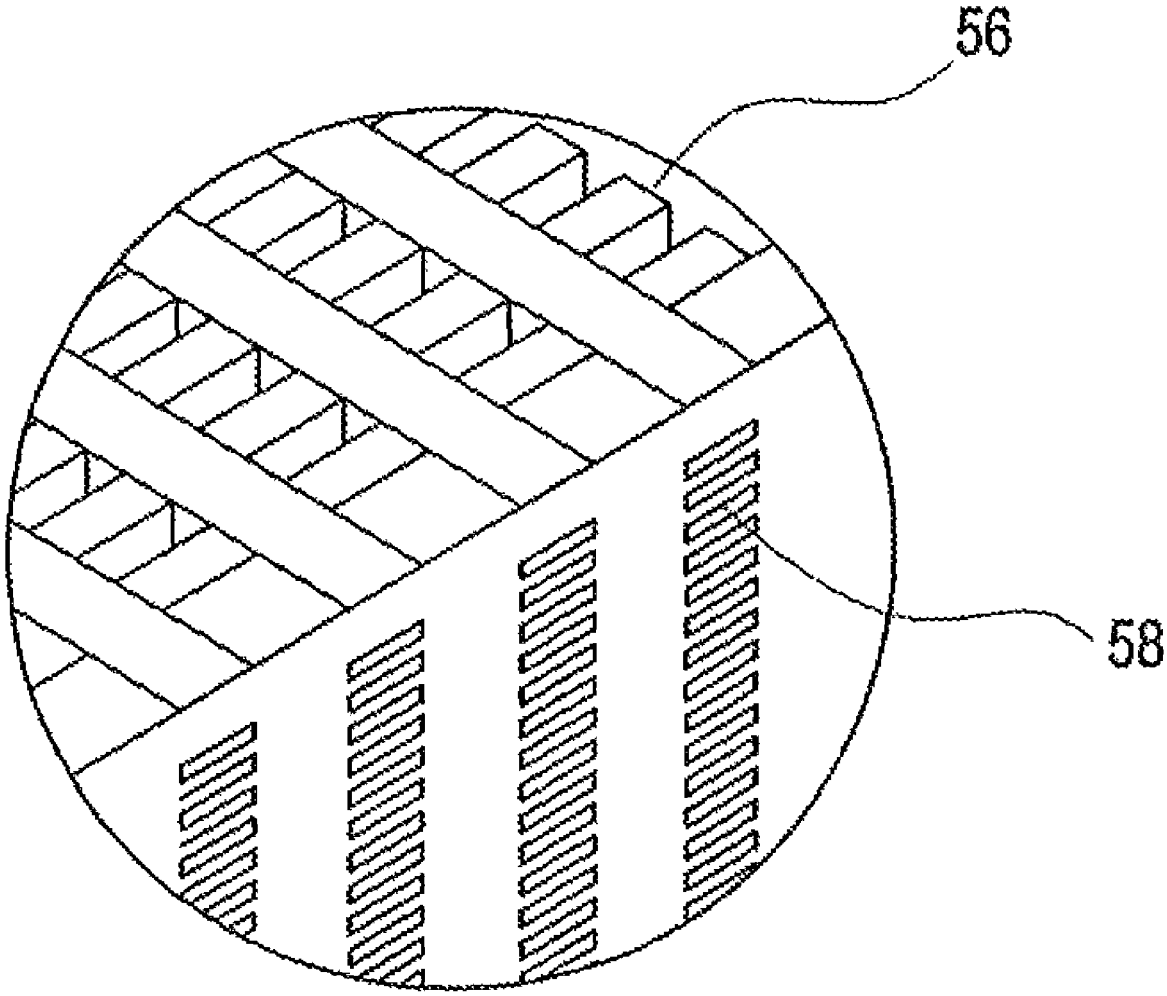
FIG. 6 is a perspective view of a part of the air-to-air heat exchanger used in the present invention.
Figure 8:
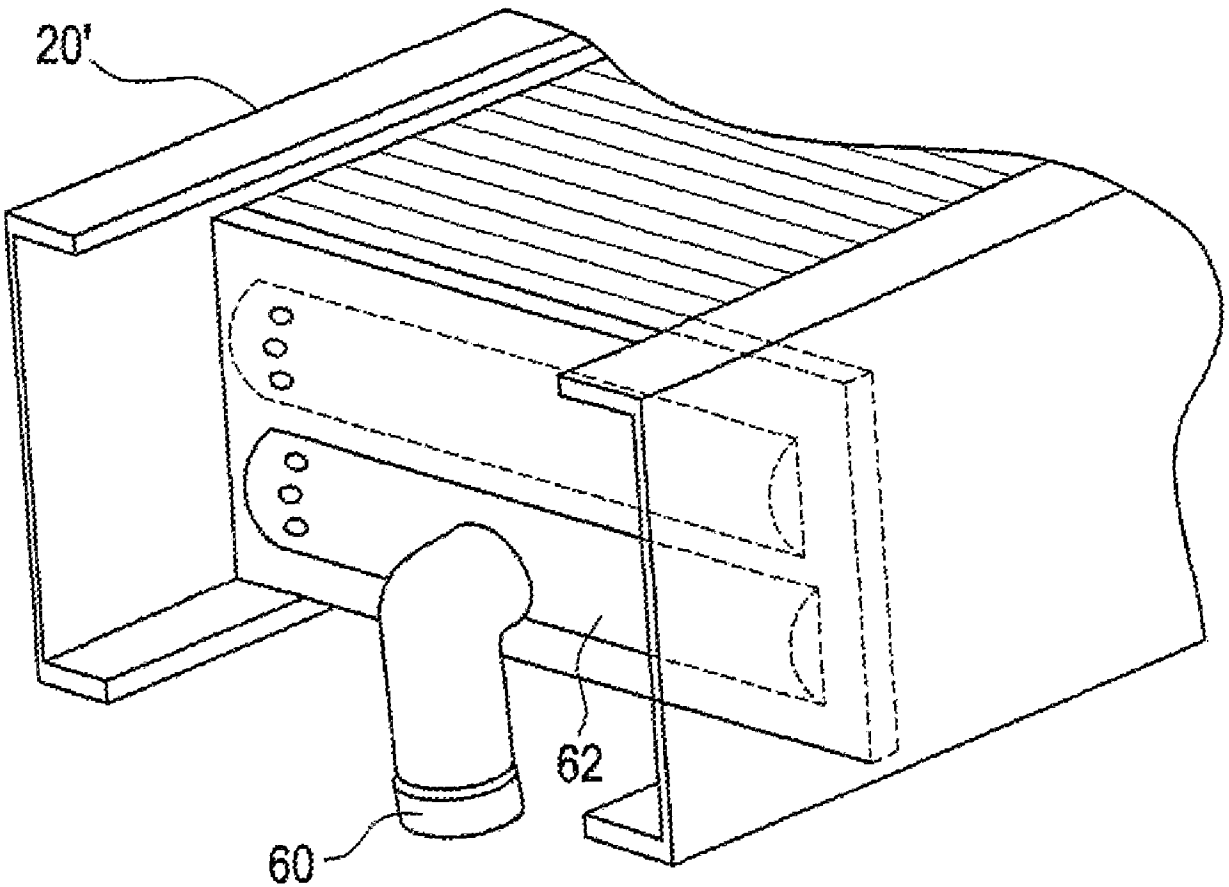
FIG. 8 is a perspective view of the end manifolds for a two pass air-to-air tube/fin cooler.

FIGS. 6 and 8 show the details of a typical cooler such as 20'. The coolers are preferably made of a modular system using vacuum brazing technology. The cooling air passes vertically through passages 56 and the compressed air makes one pass horizontally through passages 58. FIG. 8 shows a two-pass tube/fin arrangement in more detail. The one pass plate fin design is preferred for a reduced pressure drop and increased performance. An inlet 60 is connected to an inlet header 62 so as to accommodate a u-shaped path for the compressed air to be cooled, if using a two pass cooler. The cooled air outlet for two passes would then be on the same end of the cooler as the inlet 60. Alternatively, one pass for the cooled air or more than two passes could be used. The more passes the larger the size of the cooler and potentially the greater the pressure drop of the compressed air through any stage cooler. Generally oversize piping and large radius elbows are preferred to minimize pressure drop and save power. This type of exchanger, which is also known as plate-fin, can give the required cooling with pressure drops per stage of less than 1 PSI, with approach temperatures of the cooled air to ambient of less than 15 degrees and as low as less than 3 degrees. The modular components for such coolers are commercially available from API Airtech Incorporated of Arcade N.Y. U.S.A. under product designations 699-0307 through 699-0310, respectively for coolers 40, 42, 44, and 38.

Changes in the casting as between the FIG. 5 layout and the FIG. 1 layout can be done to further reduce pressure drop by elimination of unnecessary bends. For example the first stage outlet is rotated to look up in FIG. 1 from looking down in FIG. 5 so that the piping can go directly to the air cooler immediately above. To better control noise, the enclosure 50 can have sound baffles. The fan 46 also has a shroud 64 to improve performance and minimize noise.

It is worth noting that the inventors' experimental attempts to cool multi-stage centrifugal compressors with finned tube air-to-air exchangers were operational. However, the inventors saw a need for further optimization to enhance cooling performance while decreasing the package size. These efforts resulted in improvements including vacuum brazed plate-fin exchangers, parallel flow systems with a fan that pushed air through rather than pulled air through, and a cooling air flow path that cooled compressor components. This design was deemed an optimum which would most successfully compete with existing water cooled units. This conclusion was reached despite indications from those skilled in the art that pushing the air through the coolers would result in non-uniform flow through the coolers. The use of air cooling coupled with optimization of the package size allows, for the first time, a concept of portable and efficient multi-stage centrifugal compressor unit to be wheeled in, piped to an existing system and started (if it is engine driven). Alternatively, it can be hooked up electrically to the power grid at the location if it is driven by an electric motor. The newly designed system shown in FIG. 1 can occupy an equal or lesser footprint than the identically outfitted unit with water-cooling, such as depicted in FIG. 5. The FIG. 5 unit can be retrofitted by removing the tube cores out of coolers 20, 26, 28 and still directing the discharge from each stage through the now hollow cooler chambers. The outlet of each chamber would be redirected to an air cooler mounted above in the same configuration shown in FIG. 1. The cooling fan 46 is added and the operation commences on an air-cooled basis. The retrofit is fairly straightforward and, when completed, allows the disconnection of the water-cooling system equipment and the immediate savings of space and operating costs of air-cooled systems, previously described. Air-cooling affords other efficiency advantages. The airflow drawn through the enclosure 50 cools the control panel electrical components saving the installation of a panel cooler in panel 64. The same airflow over the compressors can cool them as well as the gas in the interconnecting piping. The compressor housings and the interconnecting piping can have finned exposed areas for greater heat transfer.

The use of modular sections of plate-fin air to air exchangers allows reduction of cooler approach temperatures and makes air cooling possible in high altitudes and ambient temperature applications above 105 degrees F. Water is frequently scarce in such hot environments making the present invention an economical first choice and in some cases giving an option, where no economically feasible centrifugal compression option previously existed.

For special applications, such as in the air separation business, a nitrogen booster can be piped as one of the compressors on the unit. In that manner, the relatively low pressure for compressed air requirements in air separation can be met while providing a nitrogen booster in the same air-cooled package. Additional capacity for existing water-cooling systems is not required. The final layout closely resembles that shown in FIG. 1.

Figure 7:
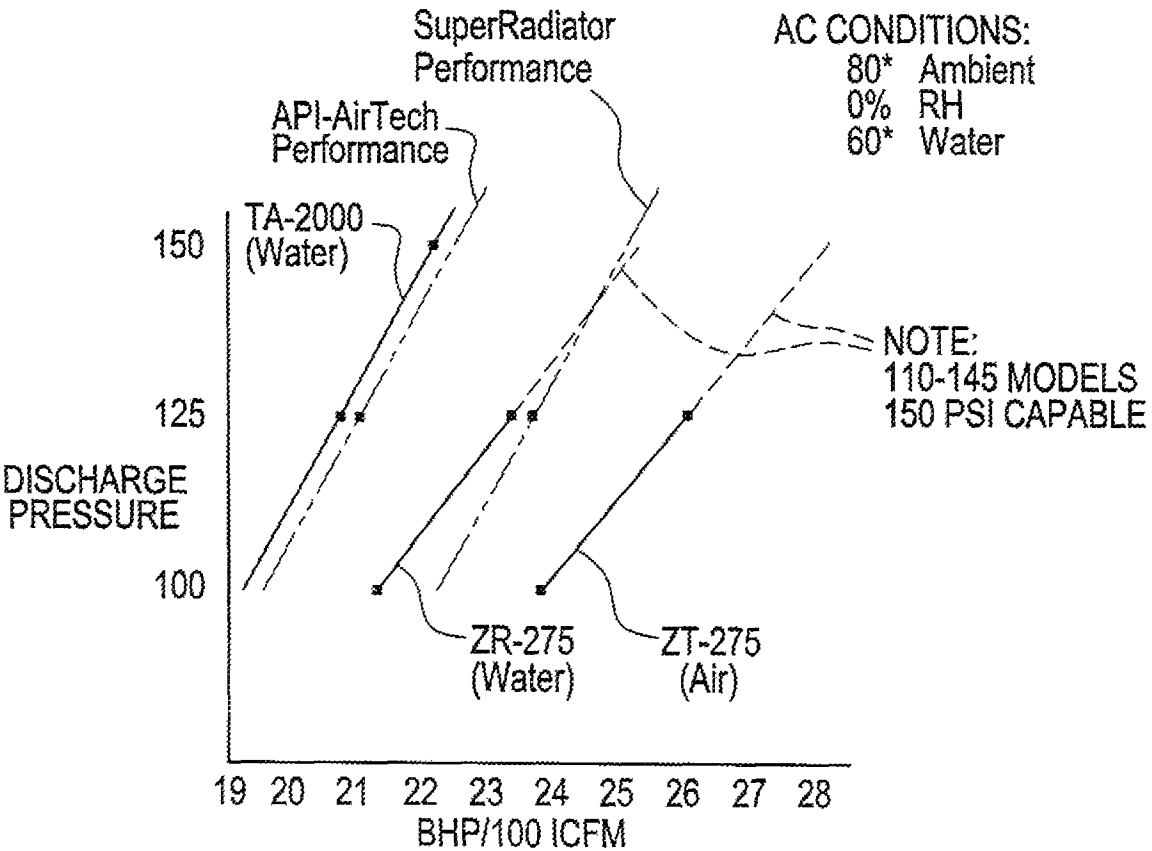
FIG. 7 is a chart showing comparable efficiency using air or water-cooling for a centrifugal compressor package and comparing that performance to an air or water-cooled positive displacement unit of comparable size.

Those skilled in the art will appreciate that the combination of an efficient multi-stage centrifugal compression system with air cooling opens new markets where water cooled units could not operate for reasons of lack of water, higher operating cost, or physical space requirements. Offshore platforms are a good example of applications with limit space availability. The air cooled design of the present invention uses the same or smaller foot print and requires no auxiliary space for the water cooling equipment such as circulating pumps. It should be noted that there was considerable doubt by end users that comparable performance could be obtained with an air-cooled unit. So much so that significantly more data about system parameters had to be released than compared to selling a water-cooled application in order to convince the end users of the viability of the concept. Graphs such as FIG. 7 were part of such disclosures.

The coolers are a modular design of a plate fin heat exchanger, using, in the preferred embodiment a single pass for the compressed gas to minimize pressure drop between stages and after the last stage. While a particular installation having 3 stages has been described, other installations with fewer or greater numbers of stages could be employed without departing from the invention. Although a single fan 46 is illustrated, multiple cooling fans are also within the scope of the invention. As an added benefit of the system shown in FIG. 1, the air drawn into the enclosure 50 cools the compressor housings and associated piping. As a result the inlet air temperature to the intercoolers, aftercooler, and oil cooler is somewhat higher than ambient. The cooling capacity can be regulated to produce a desired temperature between the stages for the compressed air. If the compressed air is being used to dry desiccant in an air dryer, the desired drying temperature can be achieved for the requisite drying time by regulation of the cooling capacity after one or more stages, which can be accomplished in the various ways previously described. The ability to package air-cooling with multi-stage centrifugal compressors opens up a previously un-served market for portable units. Custom units such as for air separation plants are possible even if existing cooling tower systems or chilled water systems have no remaining capacity. Additionally existing water cooled units can be quickly retrofitted by removing cooler cores and redirecting flow through the hollow former water cooler housings into an air cooler mounted above. The water-cooled unit of FIG. 5 can easily run as an air cooled unit having the same footprint. Many additional savings in operating costs and space for the water-cooling equipment can be realized after the retrofit conversion.

It is to be understood that this disclosure is merely illustrative of the presently preferred embodiments of the invention and that no limitations are intended other than as described in the appended claims.

The invention claimed is:

1. A method, comprising:

routing gas through a first stage centrifugal compressor comprising a first gas inlet and a first gas outlet;

routing gas through a second stage centrifugal compressor comprising a second gas inlet and a second gas outlet;

routing gas through a third stage centrifugal compressor comprising a third gas inlet and a third gas outlet;

moving cooling air by a single fan in parallel through first, second and third air-cooled heat exchangers, wherein the first air-cooled heat exchanger is coupled to the first gas outlet of the first stage centrifugal compressor and is coupled to the second gas inlet of the second stage centrifugal compressor, the second air-cooled heat exchanger is coupled to the second gas outlet of the second stage centrifugal compressor and is coupled to the third gas inlet of the third stage centrifugal compressor, and the third air-cooled heat exchanger is coupled to the third gas outlet of the third stage centrifugal compressor, wherein the first, second, and third air-cooled heat exchangers are arranged adjacent to one another in a common horizontal plane, and the cooling air is moved in a direction generally perpendicular to the common horizontal plane;

moving compressed gas through a first disabled liquid cooler disposed along a first gas flow path between the first gas outlet of the first stage centrifugal compressor and the second gas inlet of the second stage centrifugal compressor, wherein the first gas flow path extends through the first air-cooled heat exchanger;

moving compressed gas through a second disabled liquid cooler disposed along a second gas flow path between the second gas outlet of the second stage centrifugal compressor and the third gas inlet of the third stage centrifugal compressor, wherein the second gas flow path extends through the second air-cooled heat exchanger; and moving compressed gas through a third disabled liquid cooler disposed along a third gas flow path extending downstream from the third gas outlet of the third stage centrifugal compressor, wherein the third gas flow path extends through the third air-cooled heat exchanger;

wherein the first, second, and third disabled liquid coolers each have structural modifications to flow only compressed gas without any liquid coolant circulation, wherein the structural modifications include removal of liquid coolant tube cores and disconnection of liquid coolant connections to define a hollow cooler chamber.

2. The method of claim 1, comprising cooling a lubricating fluid through an additional air-cooled heat exchanger disposed in the common horizontal plane adjacent to the first, second, and third air-cooled heat exchangers.

3. The method of claim 1, wherein the single fan is positioned vertically between a multi-stage compressor assembly and the first, second, and third air-cooled heat exchangers, the single fan is oriented to push an airflow in a substantially straight path vertically upward from the single fan, through the first, second, and third air-cooled heat exchangers, and out through a vertical discharge in an enclosure.

4. The method of claim 1, wherein the first, second, and third air-cooled heat exchangers are configured to receive air at about ambient air temperature.

5. The method of claim 1, comprising compressing gas in the first stage centrifugal compressor, compressing gas in the second stage centrifugal compressor, and compressing gas in the third stage centrifugal compressor.

6. The method of claim 1, comprising altering a capacity of the single fan to control an output temperature of compressed gas from the system via a control system, wherein the control system comprises electrical components disposed along an air flow path of the single fan to enable cooling of the electrical components without a separate cooling fan.

7. The method of claim 1, comprising cooling a discharged compressed gas stream to an approach temperature of within a range of about fifty to three degrees Fahrenheit of a surrounding ambient temperature.

8. A method, comprising:

routing gas in series through first, second, and third centrifugal gas compressors disposed in a series arrangement to provide stepwise compression of a gas;

routing cooling air in parallel through first, second, and third air-cooled heat exchangers coupled directly to first, second, and third discharges of the first, second, and third centrifugal gas compressors, respectively, wherein the first, second, and third air-cooled heat exchangers are arranged in parallel but not in series with one another relative to a flow of cooling air, and the first, second, and third air-cooled heat exchangers are disposed adjacent to one another on a common plane generally crosswise to the flow of cooling air;

routing compressed gas through a gas flow path extending through the first centrifugal gas compressor, the first air-cooled heat exchanger, the second centrifugal gas compressor, the second air-cooled heat exchanger, the third centrifugal gas compressor, and the third air-cooled heat exchanger; and routing the compressed gas through a disabled liquid cooler disposed along the gas flow path, wherein the disabled liquid cooler comprises structural modifications to flow only gas without any liquid coolant circulation, and the structural modifications include removal of a liquid cooling tube core and disconnection of a liquid coolant connection to define a hollow cooling chamber.

9. The method of claim 8, comprising pulling the cooling air across the first, second, and third centrifugal gas compressors via an air mover.

10. The method of claim 9, comprising pushing the cooling air though the first, second, and third air-cooled heat exchangers via the air mover.

11. The method of claim 10, wherein the air mover is disposed between the first, second, and third centrifugal gas compressors and the first, second, and third air-cooled heat exchangers.

12. The method of claim 8, comprising moving the flow of cooling air in a substantially straight path vertically through the first, second, and third air-cooled heat exchangers via an air mover.

13. The method of claim 8, comprising cooling a discharge compressed gas stream to an approach temperature of within a range of about fifty to three degrees Fahrenheit of a surrounding ambient temperature.

14. The method of claim 10, wherein the air mover is configured to move air in a straight line path through the first, second, and third air-cooled heat exchangers and a vertical discharge disposed directly above the first, second, and third air-cooled heat exchangers.

15. The method of claim 8, comprising routing and cooling a lubricating fluid through an additional air-cooled heat exchanger disposed in the common plane in parallel but not in series with the first, second, and third air-cooled heat exchangers relative to the flow of cooling air.

16. A method, comprising:

converting a liquid-cooled centrifugal compressor system into an air-cooled centrifugal compressor system, comprising:

removing a first liquid cooling tube core from a first liquid cooler to define a first hollow cooling chamber;

disconnecting a first liquid coolant connection from the first liquid cooler and connecting a first compressed gas outlet to the first hollow cooling chamber, such that the first liquid cooler flows only gas without any liquid coolant circulation; and providing an air mover to flow cooling air along a first air path over the first liquid cooler to cool a first compressed gas path extending from the first compressed gas outlet through the first hollow cooling chamber.

17. The method of claim 16, comprising:

removing a second liquid cooling tube core from a second liquid cooler to define a second hollow cooling chamber; and disconnecting a second liquid coolant connection from the second liquid cooler and connecting a second compressed gas outlet to the second hollow cooling chamber, such that the second liquid cooler flows only gas without any liquid coolant circulation;

wherein a second air path extends over the second liquid cooler to cool a second compressed gas path extending from the second compressed gas outlet through the second hollow cooling chamber.

18. The method of claim 17, comprising:

removing a third liquid cooling tube core from a third liquid cooler to define a third hollow cooling chamber; and disconnecting a third liquid coolant connection from the third liquid cooler and connecting a third compressed gas outlet to the third hollow cooling chamber, such that the third liquid cooler flows only gas without any liquid coolant circulation;

wherein a third air path extends over the third liquid cooler to cool a third compressed gas path extending from the third compressed gas outlet through the third hollow cooling chamber.

19. The method of claim 18, comprising coupling a first air-cooled heat exchanger to the first compressed gas path, coupling a second air-cooled heat exchanger to the second compressed gas path, and coupling a third air-cooled heat exchanger to the third compressed gas path.

20. The method of claim 19, wherein providing the air mover comprises mounting the air mover to push cooling air directly from the air mover into the first, second, and third air-cooled heat exchangers arranged in a common plane, wherein a direction of the cooling air is generally transverse to the common plane.

21. The method of claim 20, comprising providing an additional air-cooled heat exchanger disposed in the common plane adjacent to the first, second, and third air-cooled heat exchangers, wherein the additional air-cooled heat exchanger is configured to route and cool a lubricating fluid.

22. A method, comprising:

routing gas through a centrifugal gas compressor to produce compressed gas;

routing the compressed gas through a disabled liquid cooler comprising structural modifications to flow only air without any liquid coolant, wherein the structural modifications include removal of liquid cooling tube cores and disconnection of liquid coolant connections to define a hollow cooler chamber; and routing the compressed gas through a duct configured to route compressed gas between the centrifugal gas compressor and an air cooler, wherein the duct comprises the hollow cooler chamber.

23. The method of claim 22, wherein the centrifugal gas compressor comprises a plurality of centrifugal gas compressor stages in series to provide stepwise compression of a gas.

24. The method of claim 22, wherein the duct comprises a path connecting an outlet of the centrifugal gas compressor to the hollow cooler chamber and another path connecting the hollow cooler chamber to an inlet of the air cooler.

25. The method of claim 22, wherein the air cooler comprises a plurality of air-cooled heat exchanger stages arranged to receive cooling air in parallel and not in series.

* * * * *